US006019586A

United States Patent [19]

Liou

[11] Patent Number: 6,019,586

[45] Date of Patent: Feb. 1, 2000

[54] GRADATIONALLY CONTRACTED SCREW COMPRESSION EQUIPMENT

[75] Inventor: Ding-Guey Liou, Hsin Chuang, Taiwan

[73] Assignee: Sunny King Machinery Co., Ltd., Taipei Hsien, Taiwan

[21] Appl. No.: 09/009,195

[22] Filed: Jan. 20, 1998

[51] Int. Cl.[7] ..... F01C 1/16

[52] U.S. Cl. ..... 418/202; 418/201.1; 418/194

[58] Field of Search ..... 418/9, 194, 201.1, 418/202

[56] References Cited

U.S. PATENT DOCUMENTS

| | | | |
|---|---|---|---|
| 1,423,768 | 7/1922 | Holdaway | 418/194 |
| 4,405,286 | 9/1983 | Studer | 418/194 |
| 4,952,125 | 8/1990 | Nagai | 418/194 |
| 4,964,790 | 10/1990 | Scott | 418/201 |
| 5,393,209 | 2/1995 | Mohr et al. | 418/202 |
| 5,533,887 | 7/1996 | Maruyama | 418/201.1 |

FOREIGN PATENT DOCUMENTS

| | | | |
|---|---|---|---|
| 00 2024280 | 3/1992 | Canada | 418/194 |
| 1309885 | 10/1962 | France | 418/194 |
| 1533194 | 1/1966 | Germany | 418/194 |
| 267384 | 10/1989 | Japan | 418/194 |
| 40 6307360 | 11/1994 | Japan | 418/194 |
| 16476 | of 1895 | United Kingdom | 418/194 |
| 384355 | 12/1932 | United Kingdom | 418/194 |

*Primary Examiner*—Thomas Denion
*Assistant Examiner*—Thai-ba Trieu

[57] ABSTRACT

A screw compressor or pump includes: a housing, two intermeshing rotors respectively rotatably mounted in the housing by two shafts; each rotor having a helix tooth spirally formed on the rotor lengthwise, with the helix tooth gradually decreasing an outer diameter of a top land surface of the helix tooth corresponding to a gradually contracted rotor chamber, and having a spiral groove juxtapositioned to the helix tooth and spirally formed in the rotor lengthwise; the spiral groove having a groove bottom surface extrapolatively defining an inner cone tapered towards a suction port side; the rotor chamber having a conical wall surface extrapolatively defining an outer cone tapered towards a discharge port side, thereby forming a gradationally contracted cavity between the spiral groove and the conical wall surface of the rotor chamber as confined between the inner and outer cones for increasing the compression or pumping efficiency.

2 Claims, 5 Drawing Sheets

GRADATIONALLY CONTRACTED SCREW COMPRESSION EQUIPMENT

BACKGROUND OF THE INVENTION

A conventional screw compressor as shown in FIGS. 6,7 comprises: a housing H, two intermeshing rotors R, R' respectively secured on two shafts S, S' rotatably mounted in the housing H for sucking air or gas from the inlet suction port I and compressing the air or gas to be discharged through the outlet port E. The rotor R has an equal depth D for the groove G between adjacent teeth T and a rotor chamber C for mounting the rotors R, R' therein having an equal diameter of the rotor chamber and an equal diameter of each rotor tooth T.

However, such a conventional compressor has the following drawbacks:

1. The grooves G of constant depth D among the teeth T to the length of the rotor R are provided for delivering the intake air or gas only, while the compression is essentially done adjacent the outlet port E to cause a great friction or compression heat produced near the outlet port E; the heat thus accumulated may deteriorate the machine parts or materials, consuming shaft work and decreasing the compression efficiency.

2. For ensuring a complete stroke for delivering the air or gas to be compressed through the grooves in the rotors, the length of the rotor and shaft can not be shortened, thereby occupying a big space for accommodating such a compressor.

3. A sudden compression occurring adjacent the outlet port E may cause serious molecular collision of the fluid and vibration of the equipment, easily causing noise pollution.

4. The long rotor and shaft may decrease the rigidity, being easily vibrated or damaged.

5. For overcoming any excessive gas backflow through such a long rotor, a higher rotor tangential speed should be maintained to easily cause noise and also waste much shaft work.

The present inventor has found the drawbacks of the conventional screw compressor, and invented the present screw compression equipment with gradationally contracted rotor diameter and spiral grooves.

SUMMARY OF THE INVENTION

The object of the present invention is to provide a screw compressor or pump including: a housing, two intermeshing rotors respectively rotatably mounted in the housing by two shafts; each rotor having a helix tooth spirally formed on the rotor lengthwise, with the helix tooth gradually decreasing an outer diameter of a top land surface of the helix tooth corresponding to a gradually contracted rotor chamber, and having a spiral groove juxtapositioned to the helix tooth and spirally formed in the rotor lengthwise; the spiral groove having a groove bottom surface extrapolatively defining an inner cone tapered towards a suction port side; the rotor chamber having a conical wall surface extrapolatively defining an outer cone tapered towards a discharge port side, thereby forming a gradationally contracted cavity between the spiral groove and the conical wall surface of the rotor chamber as confined between the inner and outer cones for increasing the compression or pumping efficiency.

DETAILED DESCRIPTION

Figure 1:
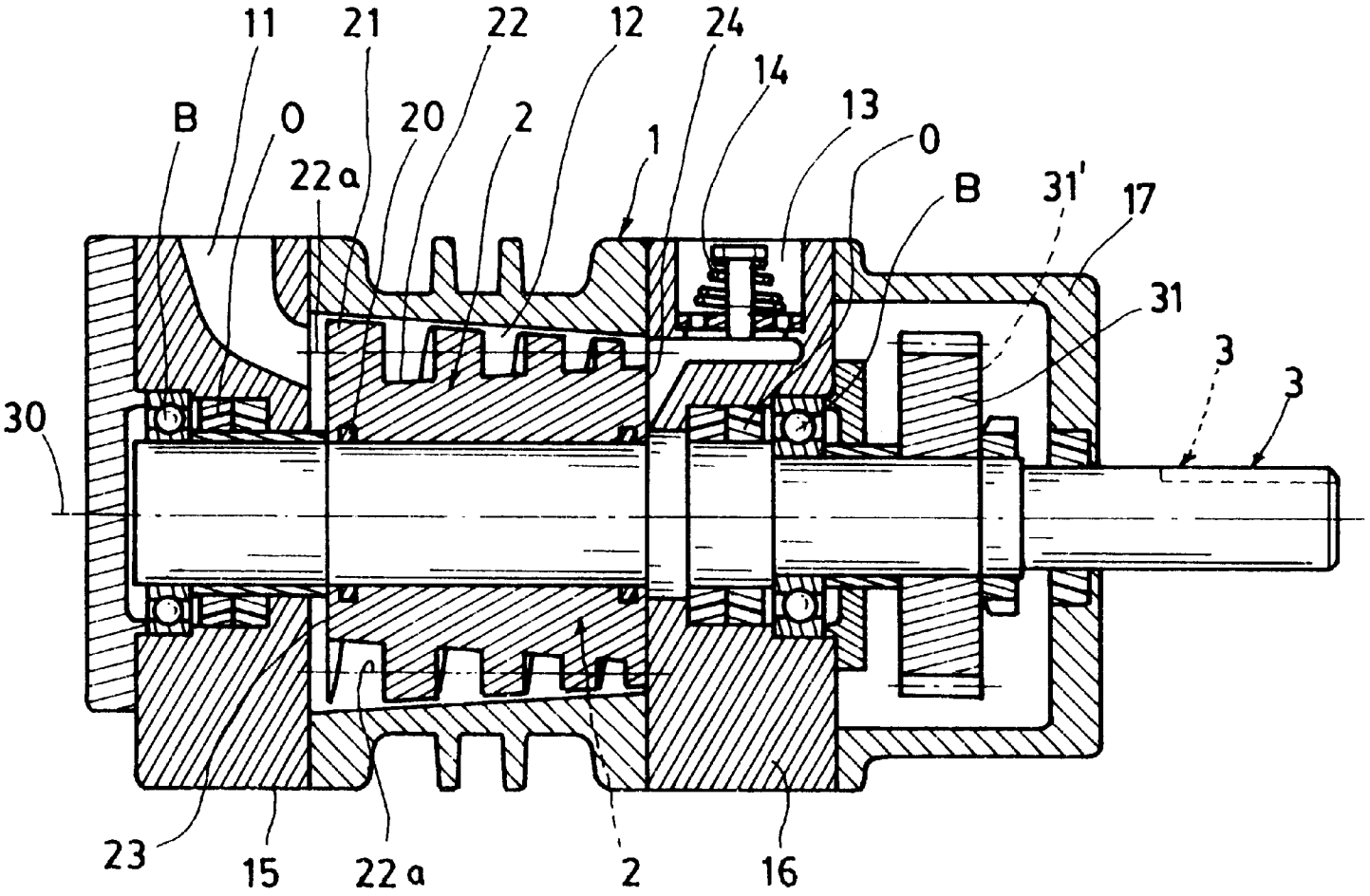
FIG. 1 is an elevational sectional drawing of the present invention.
Figure 2:
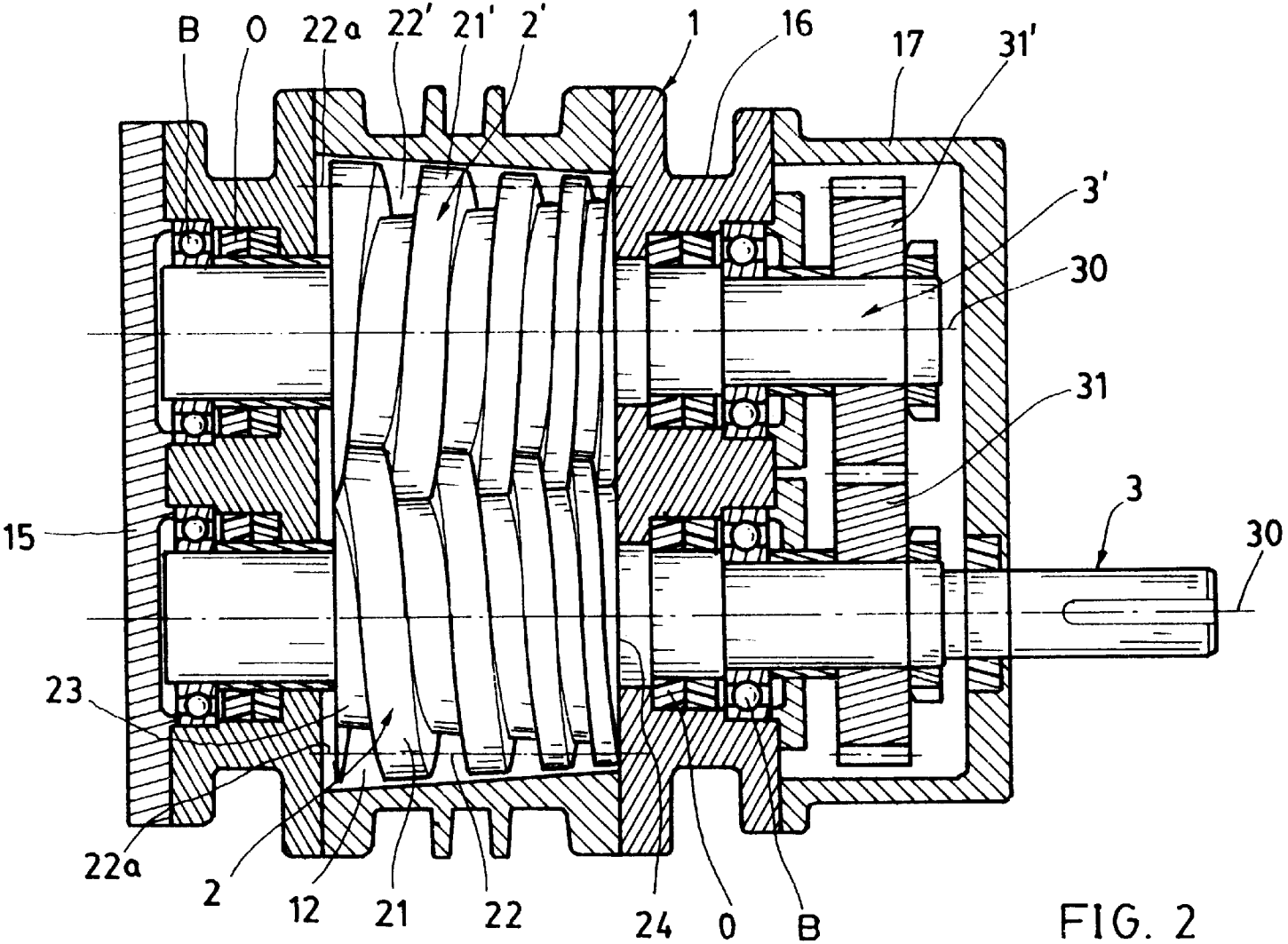
FIG. 2 is a top view cut-away illustration of the present invention.

As shown in FIGS. 1–5, the screw compression equipment of the present invention comprises: a housing 1, and two intermeshing rotors 2, 2' respectively mounted in the housing 1 by two shafts 3, 3'. The screw compression equipment may refer to a compressor or a vacuum pump, not limited in the present invention.

The housing 1 includes: a suction port 11 formed in a first portion 15 of the housing for gas or air intake through the suction port 11, a rotor chamber 12 formed in a central portion of the housing for rotatably mounting the two meshing rotors 2, 2' in the rotor chamber 12, a discharge port 13 formed in a second portion 16 of the housing 1 for discharging gas or air after being compressed or pumped outwardly having a check valve 14 formed in the discharge port 13, and a gear box 17 attached to the housing 1 for storing two gears 31, 31' of the two shafts 3, 3' therein.

The two meshing rotors 2, 2' includes a driving rotor 2 and a driven rotor 2', each rotor 2 (or 2') having a helix tooth 21 (or 21') continuously spirally formed on the rotor and a spiral groove 22 (or 22') juxtapositioned and contiguous to the helix tooth 21 and spirally formed in the rotor for forming a "compression cavity" as defined between the grooves 22, 22', the helix teeth 21, 21' and the rotor chamber 12 of the housing 1; and having a suction end surface 23 formed on the rotor adjacent to the suction port 11 and a discharge end surface 24 formed on the rotor adjacent to the discharge port 13.

The helix tooth 21 has its top land surface 211 approximating very closely to the inside wall 121 of the rotor chamber 12 to minimize the clearance and gas leakage.

The driving rotor 2 is secured on a driving shaft 3 having a driving gear 31 formed on the driving shaft 3 to be engageable with a driven gear 31' formed on a driven shaft 3' on which the driven rotor 2' is secured; each rotor defining a shaft axis 30 (or 30') longitudinally in each rotor. Sealing rings O and bearings B are provided for rotatably mounting the shafts in the housing. Each rotor has also be sealed by sealing rings 20 disposed on opposite ends of the rotor.

Figure 3:
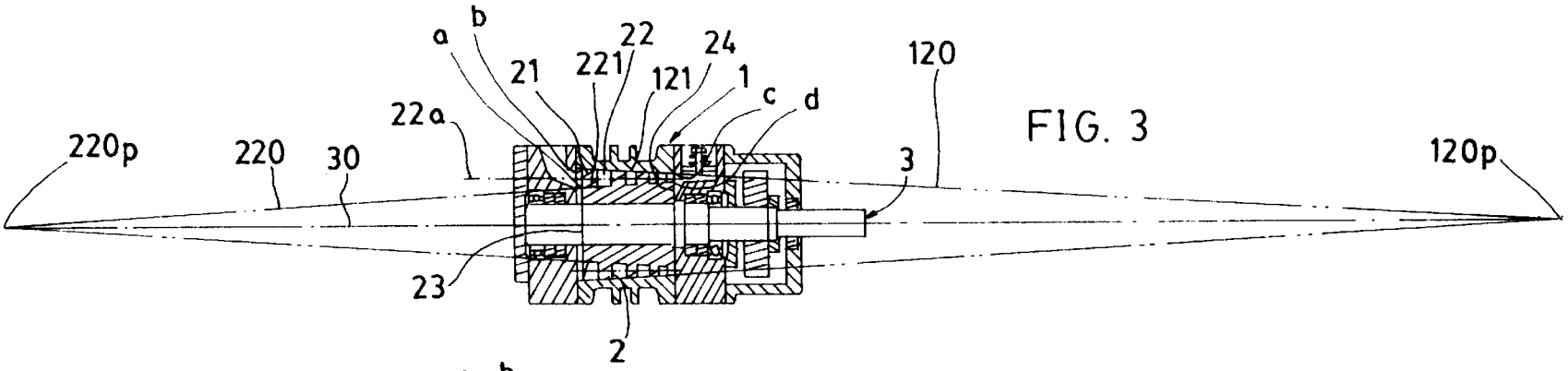
FIG. 3 is a sectional plane view formulating the relationship of the cones.
Figure 4:
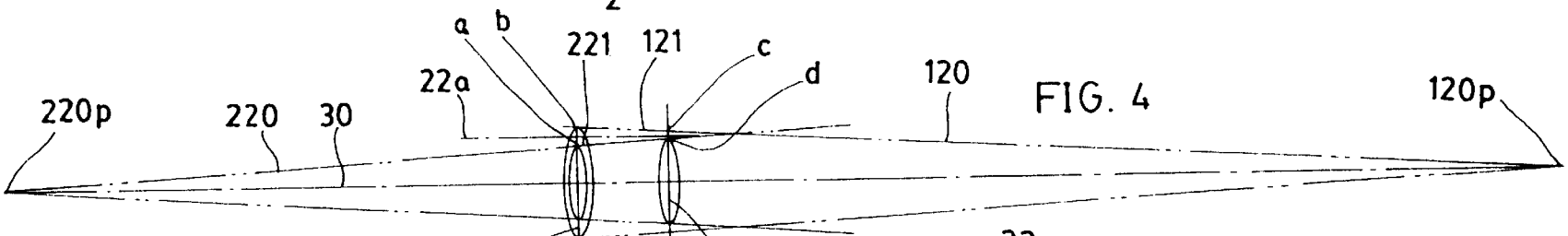
FIG. 4 is an illustration inferentially indicating the relationship of the cones.
Figure 5:
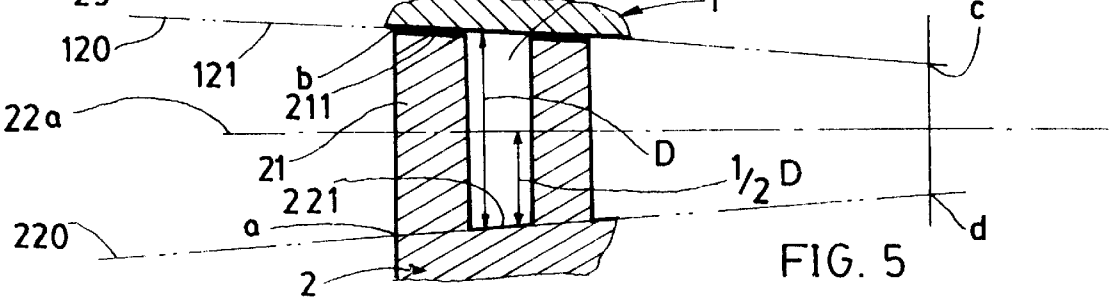
FIG. 5 is a partial enlarged view of FIG. 3.
Figure 6:
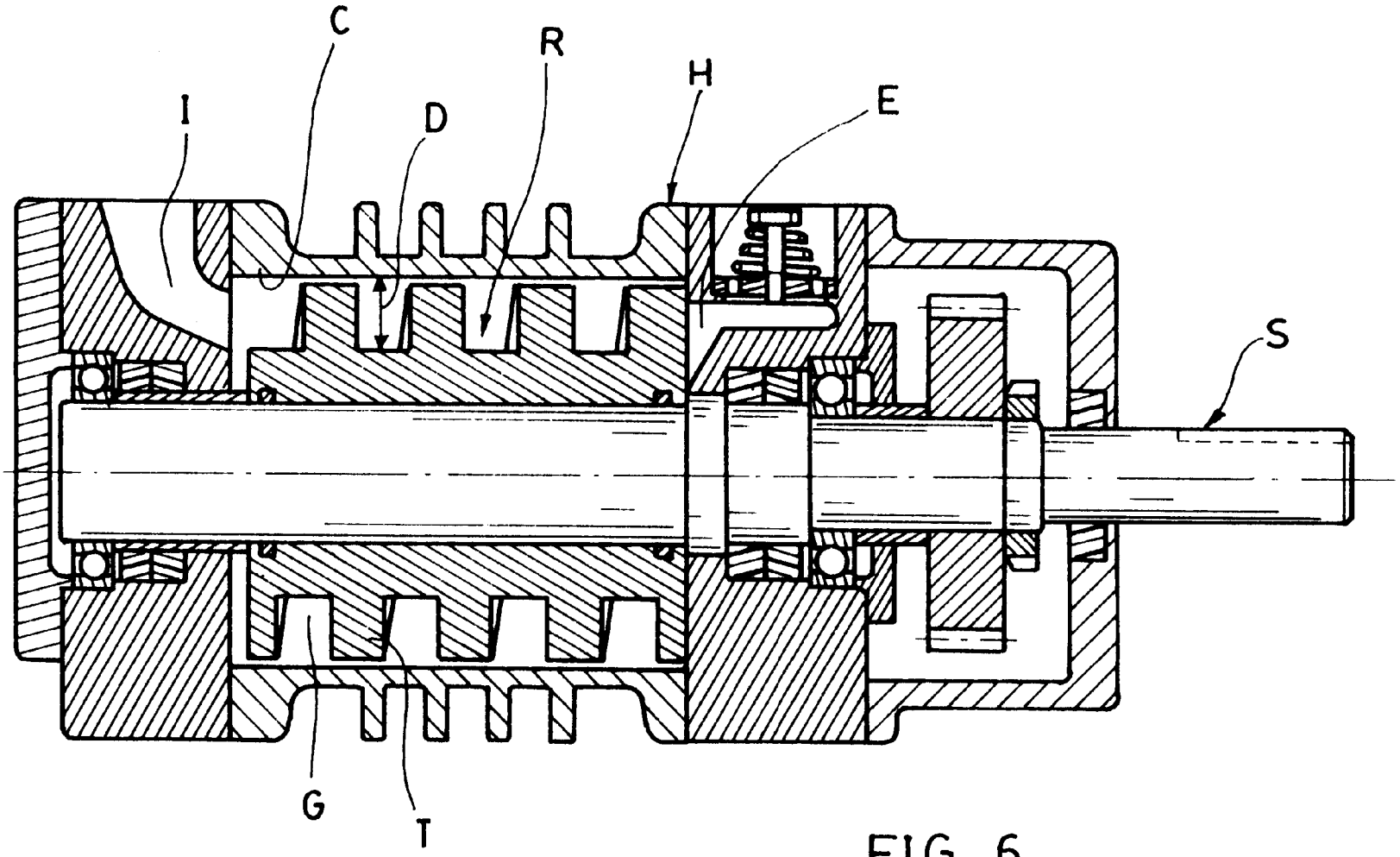
FIG. 6 PRIOR ART
FIG. 6 is an elevational sectional view of a conventional air compressor.
Figure 7:
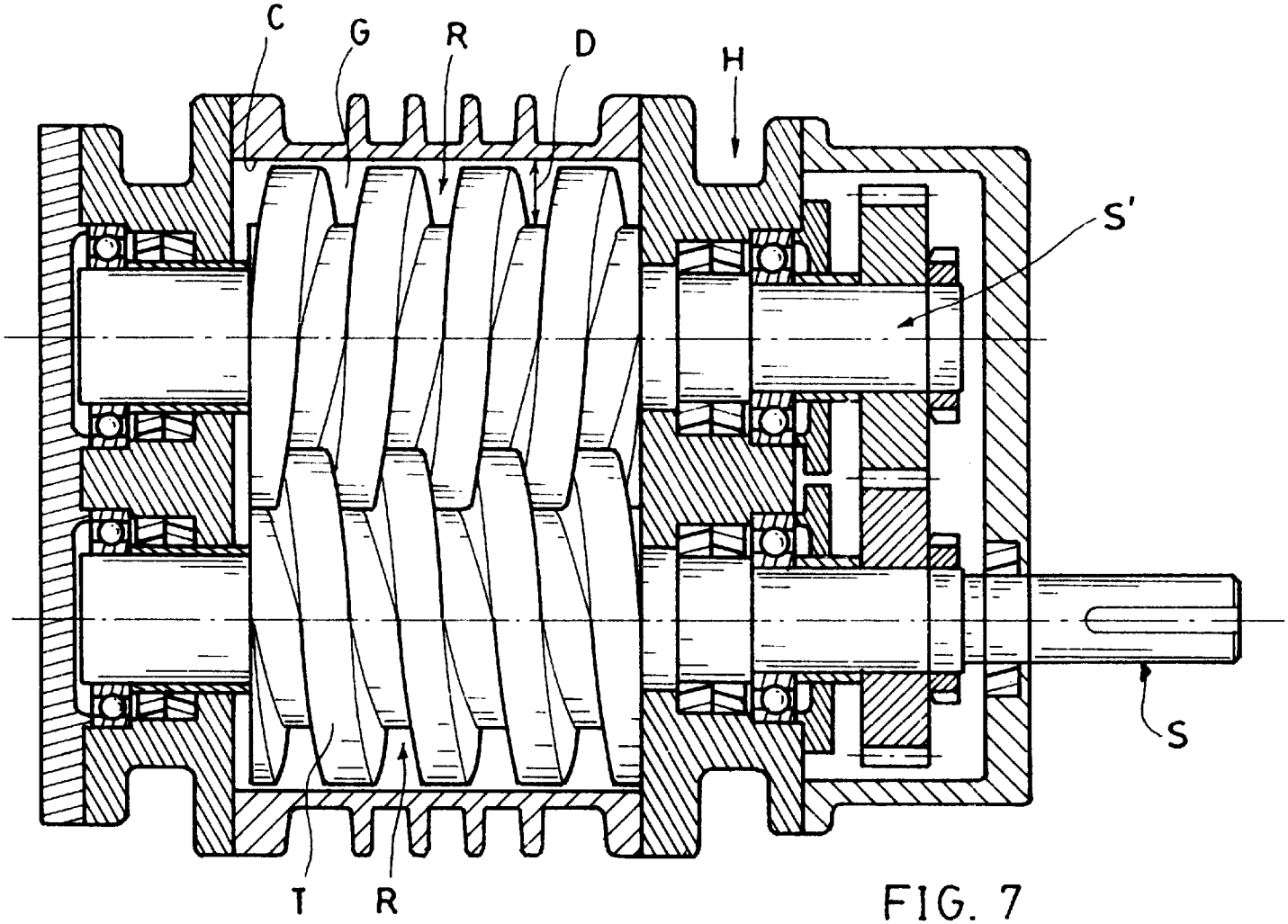
FIG. 7 PRIOR ART
FIG. 7 is a top view cut-away illustration of the compressor of FIG. 6.

The rotor chamber 12 is gradually contracted from the suction end towards the discharge end and has its truncated conical wall surface 121 extrapolatively defining an outer cone 120 as shown in FIGS. 3–5 tapered from the suction end surface 23 towards the discharge end surface 24 and towards an outer-cone apex 120*p* aligned with the shaft axis 30 of the rotor shaft.

The spiral groove 22 has a groove bottom surface 221 generally truncated-cone shaped and extrapolatively defining an inner cone 220 tapered from the discharge end surface 24 towards the suction end surface 23 and towards an inner-cone apex 220*p* aligned with the shaft axis 30 opposite to the outer-cone apex 120*p*.

The spiral groove 22 has a depth D recessed from a top land surface 211 of the helix tooth 21 towards the groove bottom surface 221 of the groove 22. The suction end surface 23 has a circular area larger than that of the discharge end surface 24.

The inner cone 220 is intersected with the outer cone 120 as shown in FIG. 4 to define an annular cone between the inner cone 220 and the outer cone 120, having an annular-cone axis 22*a* longitudinally formed at a center between the conical wall surface 121 of the rotor chamber 12 and the groove bottom surface 221 of the spiral groove 22 to be generally aligned with a half depth (½D) of the depth D of the groove 22, with the annular-cone axis 22*a* juxtapositioned and parallel to the shaft axis 30, thereby forming a groove profile generally formed as a trapezoid shape "abcd" tapered from the suction end surface 23 towards the discharge end surface 24.

The compression cavity as defined between the spiral grooves, the helix teeth, and the rotor chamber 12 of the housing is gradually contracted as the trapezoidal shape abcd, as disclosed in the present invention, from the suction end towards the discharge end, thereby compressing the gas (or air) gradually progressively through the variable "leading (or guiding) passage" in the spiral grooves 22, 22' for efficiently compressing the gas. A cooling system or mechanism (not shown) may be provided along the leading passage of the groove and along the length of the rotor and housing for instantly dissipating the compression or frictional heat produced in the compression process. The shaft work can be efficiently used for the gas compression with minimized mechanical or heat loss by the present invention, thereby greatly enhancing the compression (or pump) efficiency.

The present invention is not a multiple-stage compressor (or pump) since the helix tooth and the spiral groove are respectively spirally formed on each rotor in a "single" rotor chamber of the housing of "single stage". However, such a "single-stage" housing of the present invention may provide a progressive compression job as effected by a multi-stage compressor, but simplifying the complex mechanism or structure of a conventional multiple stage compressor.

The "compression cavity" of this invention is gradually contracted by gradually decreasing the inside diameter of the rotor chamber, decreasing the tooth thickness of the helix tooth, and by forming a tapered groove profile (abcd of FIGS. 3–5) from the suction side towards the discharge side for gradationally compressing or pumping the gas (air) for enhancing the compression (pumping) efficiency.

The present invention is superior to the prior art with the following advantages:

1. The "compression cavity" between the grooves 22, 22' and the rotor chamber 12 of the housing 1 is gradually contracted to do the compression job, whereby the compression or frictional heat produced progressively will be instantly dissipated to minimize the generation of excessive heat to waste shaft work, thereby increasing the compression or pumping efficiency.

2. The rotor and shaft can be shortened to save space and volume of the complete set of compression equipment, convenient for handling and cheaper for cost. The rigidity and reliability can also be enhanced due to the shortened shaft.

3. The compression is gradationally progressively performed to have a smooth operation to minimize the vibration and noise.

4. The volume of the compression cavity is progressively reduced and the gas delivery stroke or passage is shortened to possibly decrease the gas leakage and increase the volumetric efficiency of the compression equipment.

The present invention may be modified without departing from the spirit and scope of this invention.

I claim:

1. A screw compression equipment comprising:

a housing having a suction port formed in a first portion of said housing, a discharge port formed in a second portion of said housing, and a rotor chamber formed in said housing between said suction and discharge ports; two intermeshing rotors respectively rotatably mounted in said housing by two shafts, each said shaft defining a shaft axis longitudinally in said housing; said rotor chamber having an inside diameter gradually contracted from a suction end surface of said rotor towards a discharge end surface thereof;

each said rotor having a helix tooth spirally formed on said rotor lengthwise with gradually decreased tooth thickness of the helix tooth along a length of the rotor, and a spiral groove juxtapositioned and contiguous to said helix tooth and spirally formed on said rotor; said rotor chamber, said helix tooth, and said spiral groove defining a compression cavity which is gradually contracted along the length of the rotor for gradually decreasing a volume of the compression cavity for increasing a compression and pumping efficiency thereof.

2. A screw compression equipment according to claim 1, wherein said rotor chamber has a truncated conical wall surface extrapolatively defining an outer cone tapered from the suction end surface towards the discharge end surface and an outer-cone apex aligned with the shaft axis of the shaft;

said spiral groove having a groove bottom surface generally truncated-cone shaped and extrapolatively defining an inner cone tapered from the discharge end surface towards the suction end surface and an inner-cone apex aligned with the shaft axis opposite to the outer-cone apex;

said spiral groove having a depth (D) recessed from a top land surface of the helix tooth towards the groove bottom surface of the groove; said suction end surface having a circular area larger than that of the discharge end surface; and said inner cone intersected with the outer cone to define an annular cone between the inner cone and the outer cone, having an annular-cone axis longitudinally formed at a center between the conical wall surface of the rotor chamber and the groove bottom surface of the spiral groove to be generally aligned with a half depth (½D) of the depth (D) of the groove, with the annular-cone axis juxtapositioned and parallel to the shaft axis, thereby forming a groove profile generally formed as a trapezoid shape in said annular cone between said inner and outer cones and tapered from the suction end surface towards the discharge end surface for gradually decreasing a volume of said groove.

* * * * *